United States Patent [19]

Graefe

[11] Patent Number: 4,523,989

[45] Date of Patent: Jun. 18, 1985

[54] JIG PAN CONCENTRATOR

[75] Inventor: Ralph G. Graefe, Northridge, Calif.

[73] Assignee: Keene Engineering, Inc., Northridge, Calif.

[21] Appl. No.: 586,676

[22] Filed: Mar. 6, 1984

[51] Int. Cl.[3] ..... B07B 9/00

[52] U.S. Cl. ..... 209/44; 209/448

[58] Field of Search ..... 209/44, 443, 446–449

[56] References Cited

U.S. PATENT DOCUMENTS

| | | | |
|---|---|---|---|
| 171,747 | 1/1876 | Thompson | 209/449 |
| 270,492 | 1/1883 | Seymour | 209/448 |
| 433,983 | 8/1890 | Hatch et al. | 209/446 |
| 450,013 | 4/1891 | Hammond et al. | 209/446 |
| 452,676 | 5/1891 | Manuel et al. | 209/446 |
| 479,744 | 7/1892 | Jewell | 209/44 |
| 604,061 | 5/1898 | Mendenhall | 209/44 |
| 615,459 | 12/1898 | Mytinger | 209/446 |
| 760,664 | 5/1904 | Van Der Valk | 209/446 |
| 1,421,264 | 6/1922 | Le Roy | 209/446 |
| 2,077,476 | 4/1937 | Haultain | 209/446 |
| 3,232,426 | 2/1966 | Caparrella et al. | 209/44 |
| 4,150,749 | 4/1979 | Stevens | 209/446 X |
| 4,289,241 | 9/1981 | Litrap | 209/447 X |
| 4,319,985 | 3/1982 | Hibbard | 209/3 |

OTHER PUBLICATIONS

Walter L. Badger & Warren L. McCabe, Elements of Chemical Engineering, 2nd ed., (1936), McGraw-Hill Book Co., Inc., N.Y., pp. 285–286.

*Primary Examiner*—Charles Hart

*Attorney, Agent, or Firm*—Emmette R. Holman

[57] ABSTRACT

The obdurate hard cake, loaded with gold particles, that forms on the bottom and four sloping walls of the reciprocating deep rectangular jig pan by the compaction and dewatering of the suspended solids is eliminated, and the recovery of gold is significantly improved by a combination of:

1. a rectangular pressurized water manifold spaced slightly above the plane of the pan bottom and provided with at least one row of jet orifices directed at the bottom;
2. four steeply sloped walls at a dihedral angle of about 65° with the plane of the open top of the pan;
3. a V-bottom with the valley aligned parallel to the flow of slurry;
4. a broad skimmer blade on the spillway gate, oriented coplanar with the surface of the slurry and directed backwardly against the flow;
5. a connecting rod in the drive train which is resiliently biased, in thrust and in pull directions, by adjustable spring means;
6. a ratchet elevator, whereby the pan can optionally be tilted and secured at any one of 5 positions for the progressive decantation of the slurry in the pan while the reciprocation of the pan and the concentration of the gold values continues uninterruptedly.

The reciprocation is transverse to the direction of flow.

8 Claims, 9 Drawing Figures

1
2
3
4
5
6
7
8
22
23
25
41
42
43
44
45
47
48
49
50
61
65
66
82
83
84
85
4
4

2
3
4
5
6
61
65

2
4
5
6
7
8
9
11
12
13
14
34
34
65

JIG PAN CONCENTRATOR

BACKGROUND OF THE INVENTION

The development of deep, rectangular jig pans for the recovery of gold, or other heavy values, from wet alluvial sands has been hampered in the past by the tendency of hard cake, loaded with gold particles, to form on the bottom and on the four walls of the pan by the compaction and dewatering of the suspended solids of the slurry.

Now I have found that the formation of this obdurate hard cake is avoided and the recovery of gold values is significantly improved by a combination of:

1. a rectangular pressurized water manifold spaced slightly above the plane of the pan bottom and provided with at least one row of jet orifices directed at the bottom;

2. four steeply sloped walls at a dihedral angle of about 65° with the plane of the open top of the pan;

3. a V-bottom with its valley aligned parallel to the direction of flow of the slurry;

4. a broad skimmer blade on the spillway gate, oriented coplanar with the surface of the slurry and directed backwardly against the flow; and 5. a connecting rod in the drive train which is resiliently biased, in thrust and in pull directions, by adjustable spring means.

The reciprocating motion is purely linear, horizontal and perpendicularly transverse to the direction of flow of the aqueous/slurry of gold-bearing sand or gravel through the pan. Simultaneously, the finest gold particles, 300M and 400M, which are normally lost in the tailings, are recovered from 12M sands in high yields of 96% and 93%, respectively, without resort to amalgamation.

The closest prior art device known to me is U.S. Pat. No. 171,747 issued on Jan. 4, 1876 to J. M. Thompson, which teaches a deep, rectangular pan which, in plan view, is more elongated than my pan. The Thompson pan is vertically supported on 4 wobble pins allowing the pan freedom to reciprocate in any combination of simultaneous transverse and longitudinal motions. The effective length of the wobble pins is equal to the radius of curvature of the surface of a sphere on which is scribed the locus of the track of any given point of the moving pan. Hence the motion of the Thompson device conforms to tracings on a spherical surface, not on a plane surface, hence it is not linear motion, although Thompson states in his patent that it is linear. The longitudinal motion backward is slow; forward it is fast, each fast stroke terminating in a percussive stop as the pan strikes a rigid, stationary buttress. The percussive jolts progressively advance the load of sand or gravel forwardly in the pan. Thompson states that his device processes the gravel or sand either dry or in aqueous suspension, however, there is no teaching of the addition of the water, no water manifold, no skimmer blade on the spillway gate, no transverse linear motion. All other rectangular pans of the prior art of which I am aware and cite herein are shallow pans or riffle tables.

U.S. Pat. No. 452,676 issued to F. Manuel, et al, on May 19, 1891, teaches an enclosed deep pan, a circular cone, with its axis of rotation laid horizontal, for the concentration of an aqueous slurry. The ore slurry is fed overhead at the large diameter end of the pan. The slurry of tailings is withdrawn through a sluice gate in the small diameter end wall. The bottom of the conical pan is provided with a longitudinally oriented semicircular cylindrical trough with a screw conveyor fitted therein to move the concentrated values backwardly toward a sluice gate in the large diameter end wall, that is, counter-current to the direction of flow of the slurry. The motion of the pan is a combination of: 1—reciprocal axial rotation of the cone, 2—reciprocal cantilevered rocking of the cone, end for end, above a fulcrum provided near its large diameter end wall, and 3—vertical percussive jolts. Water is introduced in the slurry feed and also through a horizontal pipe manifold coaxial with the conical pan and positioned above the level of the surface of the slurry. The orifices in the pipe manifold are directed radially from the pipe in all directions along its length. As compared with the disclosure of the present invention: the pan is not rectangular; the manifold is not rectangular and it is not spaced slightly above the bottom of the pan with jet orifices directed downwardly at the bottom; no skimmer blade is provided in the spillway sluice gate; the reciprocating motion is not linear.

U.S. Pat. No. 1,421,264 issued to R. Le Roy on June 27, 1922. As in the preceding patent to Manuel, et al, this patent teaches a deep pan, conical in shape, with its axis of rotation laid horizontal. In this case, the upper portion of the cone is omitted and is left open. The pan reciprocates in an axial rotational rocking motion of the cone. The ore slurry is fed at the small diameter end of the pan and the tailings slurry overflows over spillway gates on both sides at the large diameter end of the pan. The values concentrate is withdrawn through a valve near the bottom of the large diameter end wall. Special ram means is provided in this valve to break up the compacted cake that forms in this valve and for some distance inside the pan. Secondary pressurized water is introduced coaxially of the conical pan through a horizontal pipe manifold positioned beneath the surface of the slurry. As in the preceding patent the orifices in the pipe manifold are directed radially from the pipe in all directions. As compared with the disclosure of the present invention: the pan is not rectangular; the manifold is not rectangular and is not spaced slightly above the pan bottom with jet orifices directed downwardly at the bottom; no skimmer blade is provided in the spillway gates; the reciprocating motion is not linear.

The advantage of the deep jig pan over the shallow riffle board is its high feed rate capacity and its ability to handle aggregate of wide range of particle size. This eliminates the need for pre-screening the ore for separation into fractions of smaller range of particle size, each of which size requires a different set of panning conditions usually carried out on separate riffle boards.

Prior art patents relating to shallow pans and riffle boards are much more numerous than the deep pan patents described above. With shallow pans and riffle tables the water is introduced via an overhead outlet to the ore feed as is taught in:

| U.S. Pat. No. | Issue date | Inventor(s) |
|---|---|---|
| 433,983 | Aug. 12, 1890 | D. P. Hatch, et al |
| 479,744 | July 26, 1892 | W. M. Jewell |
| 604,061 | May 17, 1898 | W. E. Mendenhall |
| 2,077,476 | Apr. 30, 1937 | H. E. T. Haultain |
| 4,150,749 | Apr. 24, 1979 | H. W. Stevens |
| 4,319,985 | Mar. 16, 1982 | W. M. Hibbard |

Of these patents, pure linear motion is taught only in Mendenhall and in Stevens. Pendulum arc transverse motion is taught in Hatch, et al, in Jewel, and, in the case of Haultain, the pendulum arc in both transverse and longitudinal combined motions, with a forwardly-directed jolt in addition. Thus, the Haultain movement is traced on the concave interior of a spherical surface as compared with the exterior convex surface of the sphere ascribed above to the Thompson patent. In the case of Hibbard the riffle board is motionless.

In the Mendenhall patent the tray carriage reciprocates linearly on stationary rollers. In the Stevens patent a Wilfley table (see Elements of Chemical Engineering by Walter L. Badger and Warren L. McCabe, second edition, (1936) McGraw-Hill Book Co. Inc., New York, pp. 585–6) is used which carries parallel cleats terminating along a diagonal line of the table. The table is tilted so that the slurry flows from the high corner to the low corner in the direction of the diagonal line. The linear motion of reciprocation is parallel to the direction of the riffles, hence the motion is not horizontal and also it is oblique to the direction of slurry flow, not perpendicularly transverse. The table reciprocates on linear ball bearing races which are inclined from horizontal.

The 3 deep pan patents previously discussed herein provide some insight into the hard cake problem. In Thompson, for example, no hard caking is mentioned and no means is provided specifically to avoid it. Thus it may be presumed that no caking was encountered, perhaps: (a) because the device was tested only with dry sand and not with the aqueous slurry, or (b) because the longitudinal percussive jolts were adequate to keep the pan scrubbed clean.

The other two deep pan patents relate to cone-shaped pans wherein means is specifically provided to withdraw compactly caked values concentrate from the bottom of the pan. In the Manuel patent such means consists of a longitudinal trough in the bottom of the pan with a screw conveyor fitted therein to move the concentrated values counter-current to the flow of the main body of slurry. In this case the percussive jolts are downthrusts, with largest amplitude at the large diameter end of the pan. The jolts augment the force of gravity and hence the compacting power of the weight of the overburden, more so at the large diameter end than elsewhere. This aggravates the caking problem the most, precisely at the location of the values drain opening.

In the Le Roy patent the main body of slurry and the concentrated values move concurrently toward the large diameter end of the pan. There a special drain valve for the concentrated values is provided with a coaxial ram rod which extends through the valve for some distance into the body of the pan in order to break up the cake and keep the valve passageway clear. Furthermore, the drain opening is shielded from obstruction by a length of pipe extending from the opening into the body of the pan. The free end of this pipe is cut at an acute angle and is oriented with its longest length at the zenith of the opening. This provides a canopy shielding the sediment below it from compaction by the weight of the overburden.

Thus, in the prior art there is no combination of these five essential elements of this disclosure: (1) a deep rectangular pan with 4 steep walls sloped at a dihedral angle of about 65°, (2) a V-bottom in the pan with the valley aligned parallel to the flow of the slurry, (3) pure linear horizontal transverse reciprocation, (4) a spillway gate with a broad skimmer blade thereon directed backwardly against the flow of the tailings slurry and coplanar with the surface thereof, and (5) a resiliently biased connecting rod in the drive train in which the compression of the spring is adjustable for fine tuning to the load versus the reciprocation frequency combination.

It is an object of the invention to increase the ore handling capacity of the jig pan concentrator.

It is another object of the invention to improve the efficiency of the jig pan concentrator in the recovery of gold from 12M sand.

It is still another object of the invention to overcome the caking problem of the linearly reciprocating rectangular jig pan concentrator.

It is still another object of the invention to provide a fine tuning adjustment in the spring biasing of the drive train to compensate for the cycle phase retardation caused by the viscous drag and slushing of the slurry in the pan and thereby to reduce the high stress loads occurring during the stroke reversals, when acceleration and deceleration is at its maximum.

These objects are successfully accomplished in the herein disclosed device.

DETAILED DESCRIPTION

Figure 1:
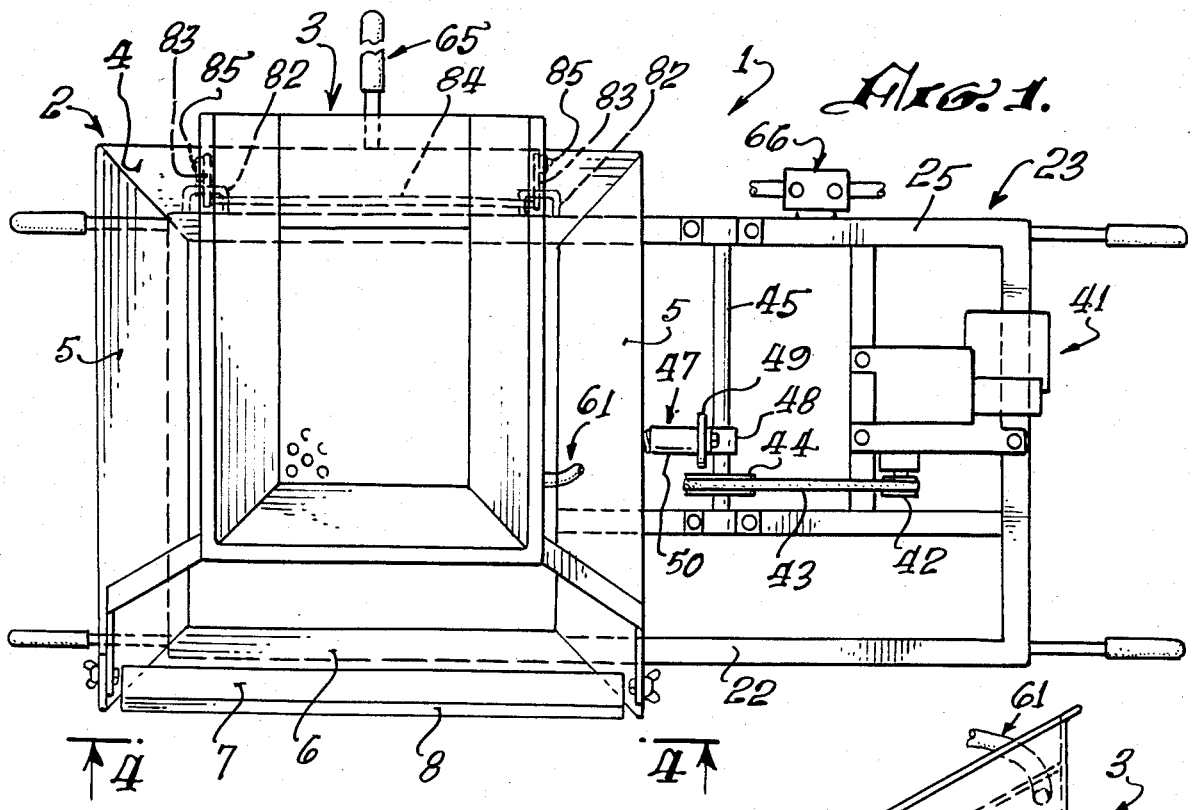
FIG. 1 is a top plan view.
Figure 3:
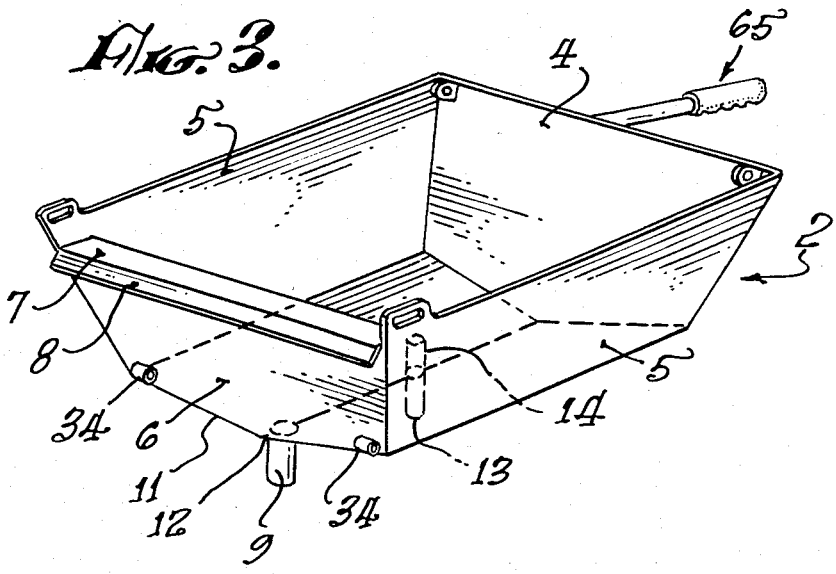
FIG. 3 is a perspective view of the jig pan itself.

Referring now to FIG. 1 the jig pan assembly, generally indicated as 1, is shown in plan view. The rectangular pan, generally indicated as 2 is shown on the left half of FIG. 1 and is better seen in FIGS. 3, 4 and 7. Removably superimposed over pan 2 is a typical inclined screen assembly, generally indicated as 3, a commercial product available in alternative embodiments on the market for years. It is familiar to artisans in this field. The inclined screen assembly 3 is not a subject of this invention, but is merely a desirable accessory. It is shown here only for completeness of the disclosure because it illustrates a convenient method for feeding the ore slurry into the jig pan 2. Therefore no detailed discussion of its details of construction is necessary.

Figure 2:
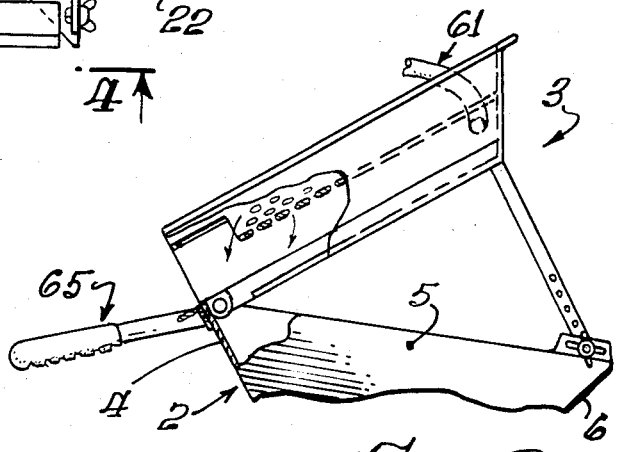
FIG. 2 is a left side fragmentary elevation of FIG. 1 showing a typical inclined wet screen mounted on top of the jig pan.

In the embodiment shown in FIG. 2 it suffices to mention that the ore is deposited, as by hand shovel, near the top of the inclined screen assembly 3 while pressurized water from an outside source is simultaneously introduced at the top into the intervening space between the inclined screen and a parallel inclined chute suspended beneath it. The coarse particles of ore, rejected by the screen, roll off and fall to the ground, while the fines pass through the screen into the cascading water stream in the chute which empties into the slightly elevated rear portion of pan 2, as close to back wall 4 of the pan as is reasonably possible.

The pan 2 is bounded by back wall 4, two side walls 5, and by front wall 6. All four walls are steeply sloped at a dihedral angle of about 65° with the plane of the open top of the pan, this plane hereinafter being designated as the "first reference plane". The front wall 6 is cut down by about one sixth of its vertical height, that is, by the extent of d/6, where d is the distance between the first reference plane and the second reference plane, the latter being the plane of the bottoms of the 4 walls of the pan. This lowering of the top edge of front wall 6 provides a spillway gate for the tailings slurry.

The trailing edge of a broad skimmer blade 7 is welded to front wall 6 across the entire length of the spillway gate with the leading edge of the blade 7 directed backwardly against the flow of the tailings slurry and with its top face coplanar with the overflowing slurry. The leading edge of a spillway lip 8 is also welded to front wall 6 across the entire length of the spillway gate with its trailing edge directed obliquely downward and forming an included dihedral angle with front wall 6 of between 45° and 110°. The leading edge of spillway lip 8 is in abutting alignment with the trailing edge of skimmer blade 7.

Figures 7, 8, 9:
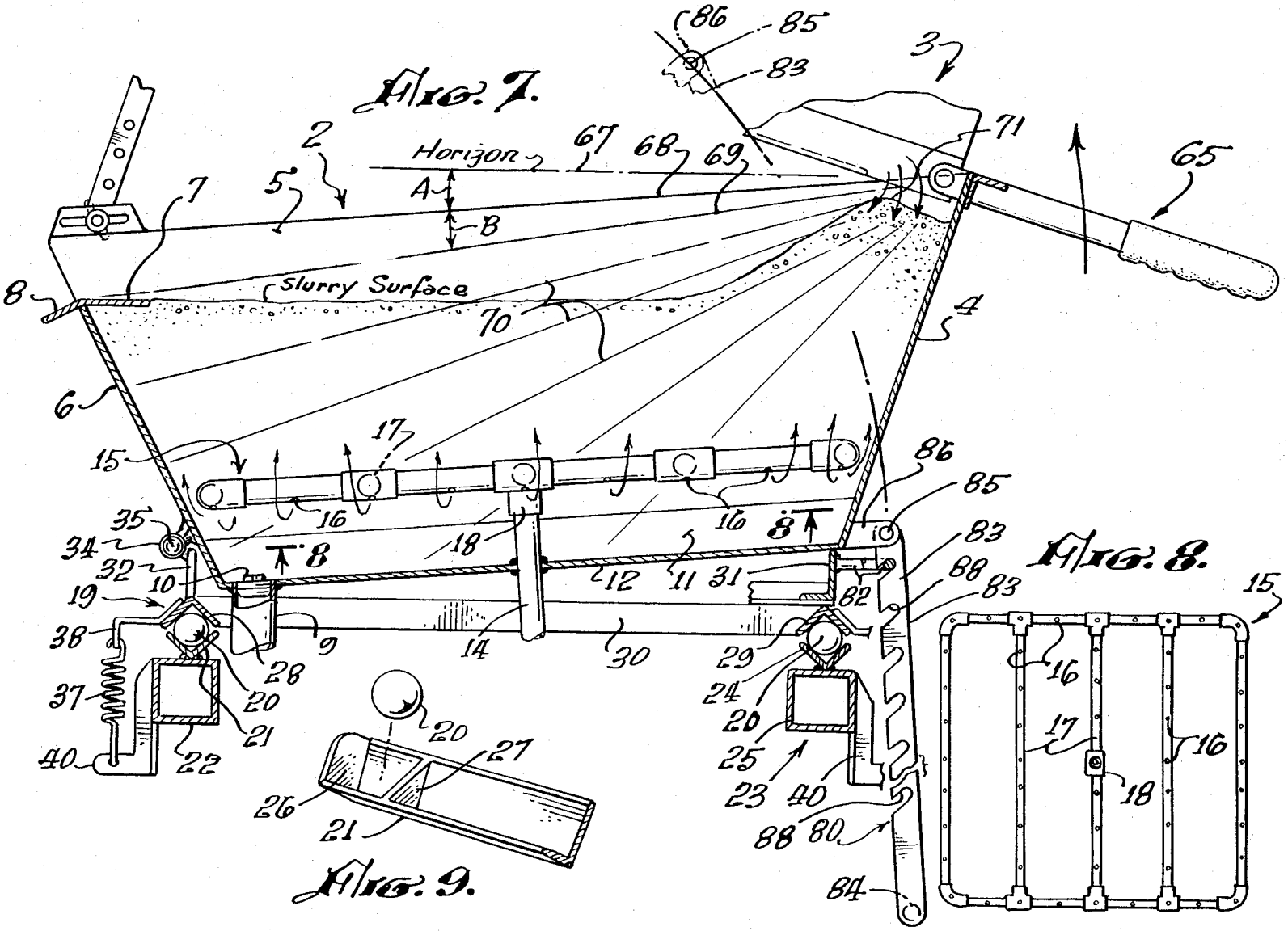
FIG. 7 is a fragmentary section with certain parts in elevation as viewed on line 7—7 of FIG. 4.
FIG. 8 is a bottom plan view of the rectangular water manifold as viewed on line 8—8 of FIG. 7.
FIG. 9 is a fragmentary exploded perspective of one of the four ball bearings and its lower horizontal race.

Thus, under full operating conditions, the rejected coarse rock falls to the ground behind back wall 4, the tailings slurry cascades over the spillway lip 8 to the ground in front of front wall 6, and the values concentrate collects within the pan on the bottom adjacent to front wall 6 where drain pipe 9, closed with removable drain plug 10 better seen in FIG. 7, is provided for the collection of the values as will be later described.

The bottom, 11, of pan 2 is longitudinally folded along its centerline into an included dihedral angle of about 163°, whereby a valley 12 is formed extending from back wall 4 to front wall 6, and depending from the above mentioned "second reference plane".

Figures 4, 5, 6:
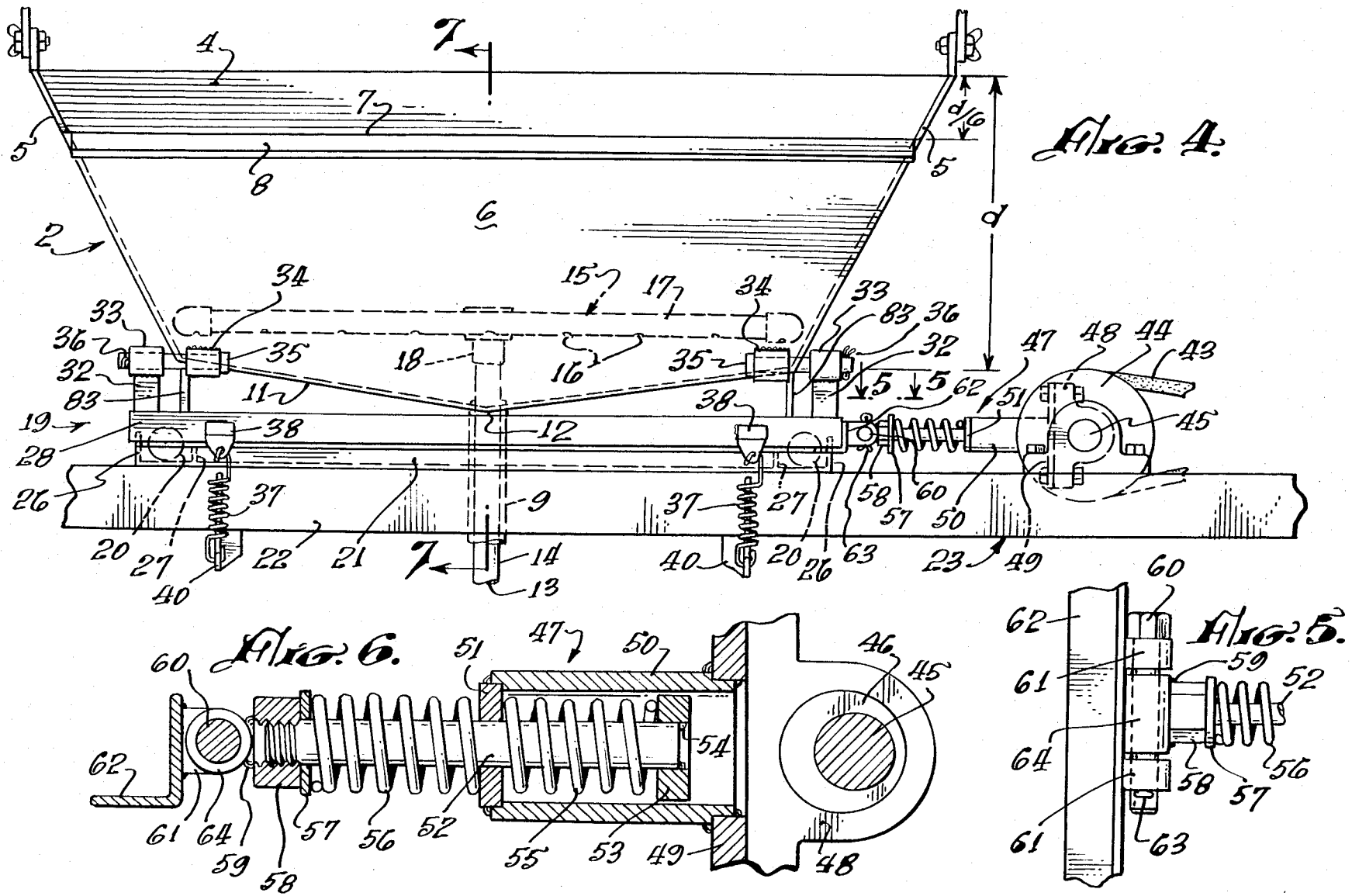
FIG. 4 is a fragmentary side elevation as viewed along line 4—4 of FIG. 1.
FIG. 5 is a small fragmental plan view as viewed on line 5—5 of FIG. 4.
FIG. 6 is an enlarged fragmentary section of the connecting rod shown in FIGS. 1 and 4.

Primary water is introduced into the ore feed via the superimposed inclined screen as already described. Secondary pressurized water from an outside source is injected through opening 13 in standpipe 14 into a rectangular open grid water manifold 15 as seen in FIGS. 4, 7 and 8. Manifold 15 is provided with at least one row of uniformly distributed jet orifices 16. All of the jet orifices are downwardly directed at the bottom 11 of the pan 2. The manifold 15 is oriented in a plane parallel to the second reference plane and is spaced therefrom a selected nominal distance h equal to from about 1" to about 2", preferably about 1.5". Manifold 15 is subdivided by at least one coplanar tubular member 17, the most central one of which is provided with a T-fitting 18 adapted to receive the top end of standpipe 14. Standpipe 14 is welded into the center of the bottom of the pan. In the present embodiment, T-fitting 18 slip-fits over standpipe 14 and is secured thereto with a hose clamp, not shown.

The pan 2 rides on a carriage assembly, generally indicated as 19, which is adapted for linear reciprocating motion on ball bearings 20, one ball supporting each of the four corners. The two front ball bearings are cradled on a lower horizontal track constructed of angle iron 21, which is welded to the front rail 22 of supporting base frame, generally indicated as 23. The two rear ball bearings are similarly cradled on a lower horizontal track of angle iron 24 which is welded to the rear rail 25 of base frame 23.

The two angle irons 21 and 24 are oriented with the corner edge on the botton and resting on top of base frame rails 22 and 25, respectively, and they are double-welded thereto with their two arms extending upwardly at a dihedral angle of 45° with the plane of the rear rail 25. The angle irons 21 and 24 are dammed at their ends with triangular terminal stops 26 welded thereat. Inboard of each of these four terminal end stops 26 at a distance of about one ball bearing diameter plus 1.5", as shown in FIG. 9, are provided triangular inboard stops 27. The clear space confined between end stops 26 and inboard stops 27 of angle iron tracks 21 and 24 define the lower ball bearing races.

The carriage assembly 19 engages the ball bearings with two upper angle iron tracks which comprise the front and rear members 28 and 29, respectively, of the welded rectangular carriage frame. The rectangular carriage frame is completed by two side members 30. As seen in FIG. 7 the bottom 11 of pan 2 is supported proximal to back wall 4 in an elevated position on angle iron member 31 welded to the top of the carriage frame over upper angle iron track 29. The front of pan 2 is supported at a relatively lower elevation by 2 columns 32 which are welded on top of the front upper angle iron track 28.

Welded to the top of column 32 is horizontally and transversely oriented journal 33. As shown in FIG. 4 a horizontally and transversely oriented journal 34 is welded, one each, into the left and right bottom corners of front wall 6 of pan 2. The left and right hand pairs of journals 33 and 34, respectively, are precisely aligned and a bolt 35 is passed, one each, through the left and right pair of journals and secured with cotter pin 36. This provides hinged articulation for tilting pan 2 forwardly to selectively decant the contents.

The upper tracks 28 and 29 are slidably secured to base frame rails 22 and 25 by tension springs 37 hooked on top to tabs 38 which are welded to upper tracks 28 and 29, and hooked at the bottom to brackets 40 which are welded to the bottom of base frame rails 22 and 25. This provision secures the pan from jumping the track while at the same time it allows limited freedom to reciprocate along the horizontal tracks.

The carriage assembly 19 is reciprocatingly driven by rotary power supplied by engine 41. I have found a Briggs and Stratton 4 cycle gasoline engine of the size used in the more powerful lawn mowers to be eminently suitable for this purpose. It provides a satisfactory variable range of speed. For speed reduction the power is transmitted from a smaller pulley 42 on the engine crankshaft via V-belt 43 to a larger pulley 44 which drives countershaft 45. As seen in FIG. 6 countershaft 45 is provided with adjustable stroke cam means 46 which drives the spring-biased connecting rod assembly generally indicated as 47. A pillow block 48 is adapted to serve as crank bearing. It is secured by 2 bolts to plate 49, which functions as base support for spring housing sleeve 50. Spring-biased connecting rod 52 is shown with retainer ring 53 welded at 54 to the right end of rod 52. First spring 55 is threaded over rod 52 followed by slip ring 51 which is then welded to housing sleeve 50 thereby enclosing the housing. Second spring 56 is then threaded over rod 52 followed by washer 57 and adjustment nut 58. Wrist pin sleeve 64 is welded at 59 to nut 58 with its axis perpendicular to and coplanar with the axis of connecting rod 52. A pair of wrist pin ears 61 is welded to angle iron member 62. After the opening in the wrist pin sleeve 64 is coaxially aligned between the two wrist pin ears, bolt 60, which is the wrist pin, is threaded through the aligned openings and is secured by cotter pin 63.

The base frame 23, in the preferred embodiment, stands on four box beam corner legs, not shown, which are integrally welded to frame 23. The legs are in turn stiffened by welding four horizontal beams to them in a rectangular frame configuration, not shown, at an elevation of about $\frac{1}{3}$ of the elevation above ground of base frame 23.

Another desirable convenience is the provision of handle 65 for added leverage in the tilting of pan 2 for purposes of dumping, or selective decantation of the slurry contents.

Still another desirable convenience is the provision of water-hose-adapted and valved receptacle 66 to receive pressurized water by hose from an outside source and to deliver primary water by hose 61 to the inclined screen assembly 3, secondary water via a hose, not shown, leading to inlet 13 of standpipe 14 under pan 2, and a third valved outlet for a utility hose, not shown, for washing down the equipment.

Referring now to FIG. 7, the open top, 68 of the pan 2 lies in a first reference plane which is tilted from horizontal reference line 67 by a first angle A. Under full operating conditions, with the pan overflowing with heavy slurry in equilibrium with the feed rate, the surface is substantially level, except for the wave motion splashing against the side walls and for the mound of unincorporated ore feed protruding above the surface at the point of impact. Construction line 69, drawn from the top 71 of the mound to the spillway gate, is inclined from horizontal reference line 67 by the angle A+B.

A pencil of schematic lines 70 converging at point 71 of ore feed, designates the idealized trajectories as well as the target impact ranges of corresponding particle sizes of gold. The term "idealized" qualifies for the fact that the slurry, including its gold particles, does not travel in straight lines, but rather in zig-zag paths, because of the reciprocating transverse wave action superimposed over the slower downhill flow.

As depicted in FIG. 7 the largest particles drop out first and impact the bottom of the pan closest to back wall 4. Only particles of 200M size and larger impact on the bottom of the pan. Finer particles than these impact on front wall 6. The coarser particles, after having impacted on the bottom 11, work their way into the valley 12 and forwardly toward drain 9. Under the transverse reciprocation, the V-bottom 11 gently nudges the sediment back into suspension, thereby enabling the particles of gold, which have a higher density than sand, to work their way down closer to the bottom while the lighter sand particles work their way upwardly in the slurry. Because the side walls are steeper, the turbulence is more vigorous adjacent to the walls, especially at the surface of the slurry where wave action surges and subsides with an amplitude of 1" to 2". Internally of the slurry mass the slapping effect of the side walls appears to dissipate and reciprocation dominates. With reciprocation there is collision-, rubbing-, and rocking-contact between neighboring particles which effectively scrubs individual particles clean of friable encrustation of aggregate fines which liberates gold values occluded within such coating layers.

As already noted, gold particles finer than 200M impact on front wall 6. Disregarding for the moment the reciprocating motion of the slurry, the net resulting movement of the slurry adjacent to front wall 6 is upward and also forwardly, in continuation of the forwardly movement of the slurry everywhere else in the pan. Starting at the bottom of wall 6 the slurry climbs upwardly, leaving behind, at drain 9, all particles of gold of size 200M or larger. The finer gold particles must work their way forwardly through this upstream of depleted tailings. The upstream sweeps the gold fines upwardly along front wall 6 into the stagnant pocket of the underside of skimmer blade 7. The gold fines are uniquely trapped in this stagnant pocket while the depleted tailings push upwardly around, then horizontally over blade 7 through the spillway gate and to waste.

Periodically, without stopping the driving engine 41, the slurry contents are selectively decanted over the spillway by tilting the pan forwardly using handle 65. In the tilted position the underside of skimmer blade 7 acts like a dam which retains all of the recovered gold, coarse and fine alike, in a concentrated form. The pan is then returned to its operating position; a suitable receptacle, not shown, is placed under drain 9; drain plug 10 is removed, and the recovered gold concentrate is washed out of the pan into the receptacle.

A ratchet elevator 80 is provided to secure the pan at any desired one of about 5 angles of tilt for decanting the slurry. The elevator is hingedly suspended by means of two ratchet arms 83. Each ratchet arm is provided in its forwardly-directed edge with 5 notches, each inclined at an angle of about 45° with the forward edge and uniformly spaced about 3.75" apart. The two ratchet arms 83 are welded at their lower ends to an interconnecting horizontal crossbar handle 84. Two U-shaped catches 82 are welded at their free ends of the U to angle iron member 31 of the carriage assembly 19 in vertical alignment with the corresponding two ratchet arms 83. The two catches 82 are adapted for simultaneous engagement with notches 88 in the two ratchet arms at any one of the 5 different angles of tilt. This permits the tilt to be selectively changed, usually in progressive steps of increasing steepness, and secured at the option of the operator without interrupting the reciprocation. This uninterrupted reciprocation is a decided advantage because it sustains the condition of the "fluidized bed", keeping all particles in suspension. When reciprocation stops, all particles quickly drop as sediment to the bottom of the pan, including the gold fines that have collected up against front wall 6 and under skimmer blade 7, leaving plain water as the supernatant liquid layer and undoing the work of isolating the gold fines that had already been accomplished.

In a series of experiments conducted in the development of the present invention, gold particles of known particle size were mixed with 12M (M=mesh) sand. This mixture was processed identically through 4 different embodiments of the present invention. Two of these embodiments used pans with walls sloping at a dihedral angle of 45° while the other two embodiments sloped at 65°. Each of these two categories was represented in one version with a narrow skimmer blade 0.5" wide and in another version with a broad skimmer blade 1.5" wide. This means, for a pan depth d=9", that the ratio of blade width to d was 0.5/9=1/18 for the narrow blade and 1.5/9=1/6 for the broad blade versions.

The type of gold used in the experiments was "grain" gold particles, which term I have coined for the purpose of this disclosure to designate chunky gold particles of low surface area per unit weight ratio as typified by the geometric sphere and cube and random shapes approximating such compactness. This "grain" gold is substantially free of and distinguishable from bulkier particle shapes having a relatively high surface area per unit weight ratio. Such shapes are elongated acicular shards and needles, or flattened plates or foils, all of which have a tendency to flutter erratically as they sediment in the slurry, like moths in flight, and they have unpredictable sediment rates.

Each of the four embodiments of the pan was run with seven particle size grades of grain gold. For each of the 28 runs the % of gold recovery is tabulated below:

| U.S. STANDARD SCREEN SIZE | | | SLOPE | | | |
|---|---|---|---|---|---|---|
| | | | 65° | | 45° | |
| | | | BLADE | | | |
| Designation | Retained on | Passing | 1.5" | 0.5" | 1.5" | 0.5" |
| 100+ M | 100 M | 80 M | 100% | 100% | 98% | 98% |
| 100 M | 150 M | 100 M | 100 | 100 | 95 | 95 |
| 150 M | 200 M | 150 M | 99 | 99 | 93 | 93 |
| 200 M | 250 M | 200 M | 99 | 99 | 88 | 88 |
| 250 M | 300 M | 250 M | 98 | 98 | 81 | 81 |
| 300 M | 400 M | 300 M | 96 | 94 | 74 | 74 |
| 300-400 M | — | 300 M | 93 | 88 | 66 | 66 |

It is apparent from these results that, for the coarse particle, the 65° wall slope is only slightly more efficient than the 45° slope. However, the superiority of the 65° versus 45° increased steadily as the gold particle size diminished. It is noteworthy that no measurable difference in gold recovery resulted from changing the width of the skimmer blade on the 45° pans. With the 65° slope measurable difference appeared only with the two finest particle sizes. Although some of the finer gold particles no doubt escaped over the spillway gate in these tests, much of the loss with the 45° slope must be attributed to gold occlusion in the hard cake which formed in the 45° pans but not in the 65° pans.

In the preferred mode the jig pan reciprocates at about 180 cycles per minute with a total displacement of about 1.25" per stroke. Of this displacement the eccentric cam delivers 0.75" and the resilience of the spring-biased connecting rod assembly 47 contributes 0.5". The function of the resilient connecting rod is not completely understood at this time, but it has been observed that it provides a smoother operation and it extends the useful service life of the most heavily stressed components. Hence it is believed that the springs absorb the shock loads that reach their maximum at the very instant of reversal of the sine wave reciprocation which, or course, is the instant of maximum deceleration/acceleration. Under full operation the jig pan concentrator has a reciprocating mass consisting of moving structural metal parts on the one hand as well as a heavy load of ore suspended in water which makes a dense, viscous slurry. The slurry slushes about from left to right as the pan reciprocates producing waves surging and receding up and down the sloping walls for a distance of about 1.0" to 2.0".

Without intending to be bound to or restricted by the hypothesis, it is believed and here offered as a possible explanation that the slushing wave motion lags out of phase with the reciprocating sine wave cycle of the driving train. Considering the cycle frequency, which is adjustable by engine RPM, and the spring-biased connecting rod, in which there is provided a limited range of adjustment of the stiffness of the springs, these two adjustments in combination allow for the selection of drive speed approximating resonating frequency with the wave motion of the slurry and allow for the compensation for the lagging power factor of the wave motion, whereby the drive cycle is synchronized with the slurry wave cycle.

SUMMARY

1. The deep rectangular jig pan concentrator is capable of efficiently processing alluvial aggregates containing silt, sand and gravel up to 0.5 inch mesh in a single pass and in high volume as compared with shallow pans and riffle boards.

2. The combination of transverse linear reciprocation plus the rectangular water manifold spaced slightly above the bottom of the pan and provided with at least one row of jet orifices directed at the bottom plus the 65° slope of the pan walls eliminates the hard cake encountered with the 45° slope and yields better gold recovery.

3. The 1.5" width of the skimmer blade provides recovery of 300M and finer gold particles that otherwise are lost in the tailings.

4. The ratchet elevator allows for selective decantation of the slurry at progressively steeper angles of tilt without interruption of the reciprocation thereby sustaining the fluidized bed condition of the slurry and improving gold recovery.

5. The spring-biased connecting rod provides smoother operation and improved service life of moving parts as compared with the rigid connecting rod. In combination with adjustable drive frequency it allows for synchronization of the drive cycle with the slurry wave cycle.

I claim:

1. In a jig pan concentrator for values occuring in sand, said values having a density greater than that of said sand, wherein said pan is a deep frustum of an inverted right rectangular pyramid having:

an open top in a first reference plane;

a closed bottom in a second reference plane parallel to said first reference plane, spaced therefrom by a selected distance d;

a transverse axis in said first reference plane which transverse axis is horizontal;

a longitudinal axis in said first reference plane, said longitudinal axis being tilted from horizontal by a selected first angle A equal to about 4°;

two sloping side walls oriented parallel to said longitudinal axis and inclined to said first reference plane at a dihedral angle of about 65°;

a sloping back wall oriented parallel to said transverse axis and inclined to said first reference plane at a dihedral angle of about 65°;

a sloping front wall oriented parallel to said transverse axis and inclined to said first reference plane at a dihedral angle of about 65°, wherein the top edge of said front wall is lowered by about one sixth of said selected distance d below said first reference plane to provide a linear, horizontal spillway gate for tailings effluent and to augment the effect of said first angle A of tilt by the amount of a second angle B, said spillway gate extending the full distance between said two sloping side walls;

a carriage frame having a front, a back, said carriage frame pivotally supporting said bottom of said pan proximal to said front wall while disengageably supporting said bottom of said pan proximal to said back wall at an elevation higher than that of said front wall to provide said tilt of said selected first angle A;

a first linear track mounting oriented horizontally parallel to said transverse axis, supporting said front of said carriage frame;

a second linear track mounting oriented horizontally parallel to said transverse axis, supporting said back of said carriage frame;

a base frame supporting said first and second linear track mountings;

driving means mounted on said base frame to provide linear translational motion to said carriage frame along said first and second linear tracks, said driving means consisting of motor means having an adjustable speed of from about 4 rpm to about 1000 rpm driving a rotary shaft, a variable stroke cam on said shaft adjustable to a stroke of from about 0.03" to about 2.0", a connecting rod connecting said cam to said carriage frame;

a valley in said closed bottom of said pan along its centerline parallel to said longitudinal axis, said valley depending from said second reference plane;

the improvement consisting of providing a flat water manifold in said pan oriented in a plane parallel to said second reference plane, spaced therefrom a selected nominal distance h equal to from about 1" to about 2", said water manifold being an open rectangle which is subdivided by at least one coplanar tubular member, said water manifold being provided with at least one row of uniformly distributed jet orifices, all said jet orifices being directed downward at said bottom of said pan, and inlet means in said water manifold for pressurized water from an outside source.

2. A jig pan concentrator according to claim 1 wherein said rectangular water manifold is supported on a standpipe erected in the center of said bottom of said pan and is hydraulically coupled to said standpipe at the middle of one of said coplanar tubular members subdividing said open rectangle.

3. A jig pan concentrator according to claim 2 wherein said standpipe penetrates through the bottom of said pan to provide said inlet for pressurized water from an outside source.

4. A jig pan concentrator according to claim 3 wherein the length of the side of the top of the cavity in said pan ranges from about 2 to about 3.5 times said selected distance d.

5. A jig pan concentrator according to claim 4 wherein the sum of said first angle A plus said second angle B is from about 5° to about 15°.

6. A jig pan concentrator according to claim 5 wherein handle means is provided on said back wall for manual tipping of said pan on said carriage frame front about said pivotal support of said bottom of said pan proximal to said front wall whereby the contents of said pan can be selectively decanted over said spillway gate.

7. A jig pan concentrator according to claim 5 wherein adjustable spring means is provided to resiliently bias said connecting rod in thrust and pull directions.

8. A jig pan concentrator according to claim 7 wherein said spillway gate for tailings effluent is provided with a backwardly-directed skimming blade oriented coplanar with the surface of the effluent, said skimming blade projecting upstream into the surface of the tailings in the pan for a distance of about one sixth of said selected distance d, extending the full distance between said two sloping side walls and including to said first reference plane at a dihedral angle of from about said angle A to about said sum of angles (A+B).

* * * * *

UNITED STATES PATENT OFFICE

CERTIFICATE OF CORRECTION

Patent No. 4,523,989 Dated June 18, 1985

Inventor(s) RALPH G. GRAEFE

It is certified that error appears in the above-identified patent and that said Letters Patent are hereby corrected as shown below:

In column 6, line 2, change "botton" to "bottom".

In claim 8, line 33, change "including" to "inclining".

Signed and Sealed this

*Seventeenth* Day of *September 1985*

[SEAL]

*Attest:*

DONALD J. QUIGG

*Attesting Officer*

*Commissioner of Patents and Trademarks—Designate*